US009526999B2

(12) United States Patent
Lin

(10) Patent No.: US 9,526,999 B2
(45) Date of Patent: Dec. 27, 2016

(54) TRAVELING TOY

(71) Applicant: GENIUS TOY TAIWAN CO., LTD., Taichung (TW)

(72) Inventor: Wen-Pin Lin, Taichung (TW)

(73) Assignee: GENIUS TOY TAIWAN CO., LTD., Taichung (TW)

( * ) Notice: Subject to any disclaimer, the term of this patent is extended or adjusted under 35 U.S.C. 154(b) by 13 days.

(21) Appl. No.: 14/162,298

(22) Filed: Jan. 23, 2014

(65) Prior Publication Data

US 2014/0213143 A1 Jul. 31, 2014

(30) Foreign Application Priority Data

Jan. 28, 2013 (TW) ..... 102103099 A

(51) Int. Cl.
*A63H 11/00* (2006.01)
*A63H 29/20* (2006.01)
*A63H 31/00* (2006.01)

(52) U.S. Cl.
CPC ..... *A63H 11/00* (2013.01); *A63H 29/20* (2013.01); *A63H 31/00* (2013.01)

(58) Field of Classification Search
CPC ..... A63H 1/00
USPC ..... 446/233
See application file for complete search history.

(56) References Cited

U.S. PATENT DOCUMENTS 1,821,940 A * 9/1931 Hinsen ..... 446/234
2,489,206 A * 11/1949 Tomnie ..... 446/274
2,588,040 A * 3/1952 Perez ..... 446/97
2,747,327 A * 5/1956 Sly et al. ..... 446/294
2,881,559 A * 4/1959 Glass ..... A63H 13/00 446/289
2,942,381 A * 6/1960 Buckey ..... 446/274
3,475,857 A * 11/1969 Douglas et al. ..... 446/288
3,492,758 A * 2/1970 Yasuta ..... 446/440
4,365,437 A * 12/1982 Jameson ..... 446/355
4,713,039 A * 12/1987 Wong ..... 446/233
5,823,845 A * 10/1998 O'Berrigan ..... A63H 1/20 446/234
6,042,449 A 3/2000 Ishimoto
7,063,589 B2 * 6/2006 Matsukawa ..... A63H 30/04 446/256
7,427,225 B2 * 9/2008 Matsukawa ..... A63H 1/04 446/256
8,220,448 B1 * 7/2012 Moggo ..... 124/89
8,833,189 B2 * 9/2014 Fahnline ..... 74/5.7
8,920,209 B2 * 12/2014 Brooks ..... A63H 1/00 446/234

(Continued)

*Primary Examiner* — Michael Dennis
*Assistant Examiner* — Dolores Collins
(74) *Attorney, Agent, or Firm* — Kirton McConkie; Evan R. Witt

(57) ABSTRACT

A traveling toy includes a gyroscopic unit, a traveling unit and an ornamental toy unit. The gyroscopic unit includes a motor having co-rotatable upper and lower output shafts, a rigid body having a rotational symmetry, and mounted co-rotatably on the upper output shaft of the motor, a driving gear mounted co-rotatably on the lower output shaft, and a transmission gear meshing the driving gear. The traveling unit is disposed below the gyroscopic unit, and includes a first bottom wheel adapted for traveling on a surface, and a gear train disposed between and meshing the transmission gear and the first bottom wheel. The ornamental toy unit is provided on the gyroscopic unit.

7 Claims, 5 Drawing Sheets

(56) References Cited

U.S. PATENT DOCUMENTS

| | | | | |
|---|---|---|---|---|
| 8,926,396 | B2 * | 1/2015 | Lennon | 446/437 |
| 2003/0129920 | A1 * | 7/2003 | Sze | 446/233 |

* cited by examiner

TRAVELING TOY

CROSS-REFERENCE TO RELATED APPLICATION

This application claims priority of Taiwanese Application No. 102103099, filed on Jan. 28, 2013.

BACKGROUND OF THE INVENTION

1. Field of the Invention

The invention relates to a traveling toy, more particularly to a traveling toy that has an unstable structure.

2. Description of the Related Art

Generally, a toy vehicle has at least three wheels for assuring stability on a support ground. There is a conventional two-wheeled traveling toy having an otherwise unstable structure, and equipped with a feedback control system that includes a controller and a plurality of sensors and actuators for maintaining the center of mass of the entire traveling toy. Although this conventional two-wheeled traveling toy is interesting, it has a complicated structure and is relatively expensive.

Referring to FIG. 1, Taiwanese Patent No. 367882 (Application No. 087218669) discloses a conventional modified spinning top 1 that is capable of maintaining its orientation through gyroscopic effect. However, the conventional modified spinning top 1 cannot travel linearly on a horizontal surface, and is capable of such linear traveling only when being placed on an inclined surface 2.

SUMMARY OF THE INVENTION

Therefore, the object of the present invention is to provide a traveling toy that has an unstable and relatively simple structure.

Accordingly, a traveling toy of the present invention includes a gyroscopic unit, a traveling unit and an ornamental toy unit. The gyroscopic unit includes a motor that has co-rotatable upper and lower output shafts extending along a vertical axis, a rigid body that has a rotational symmetry and that is mounted co-rotatably on the upper output shaft of the motor, a driving gear that is mounted co-rotatably on the lower output shaft, and a transmission gear that meshes the driving gear, and that is rotatable about a horizontal transmission axis perpendicular to the vertical axis. The traveling unit is disposed below the gyroscopic unit, and includes a first bottom wheel that is adapted for traveling on a surface, and a gear train that is disposed between and that meshes the transmission gear and the first bottom wheel. The ornamental toy unit is provided on the gyroscopic unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
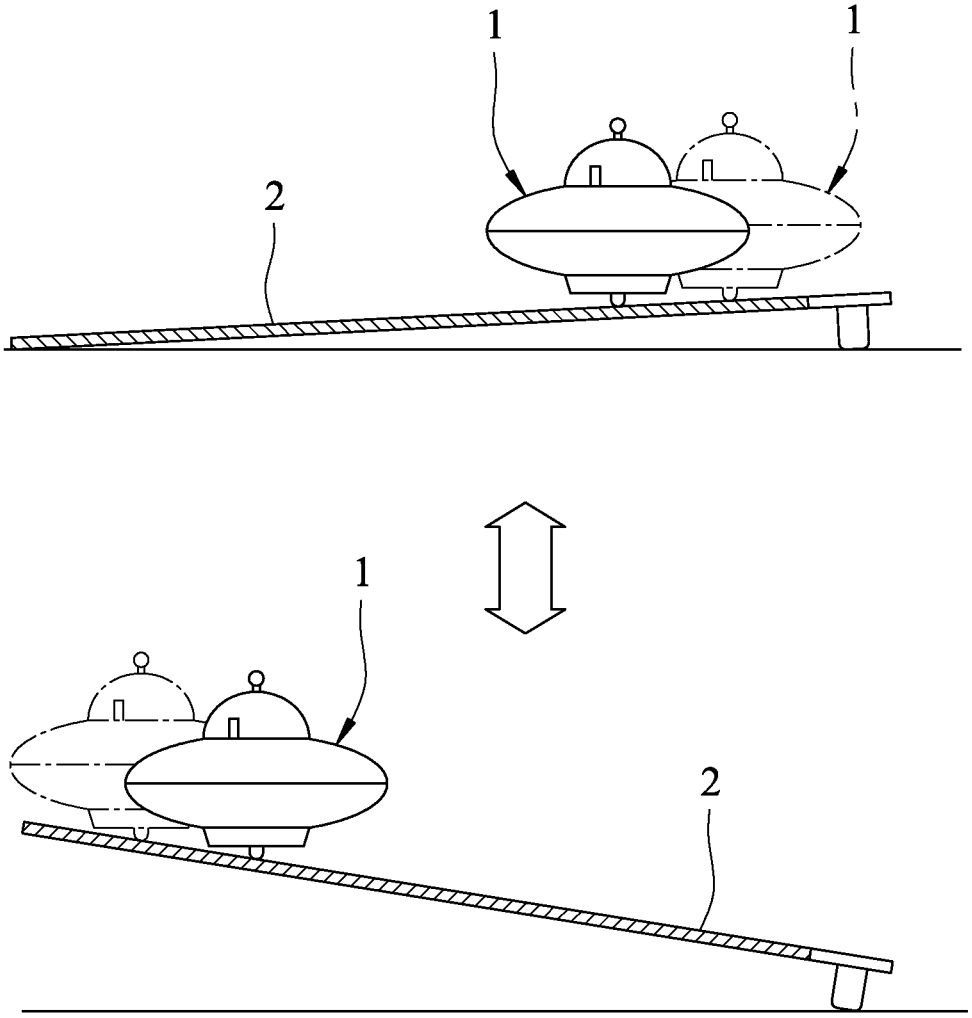
FIG.1 PRIOR ART
FIG. 1 is a schematic side view, illustrating manipulation of a conventional modified spinning top disclosed in Taiwanese Patent No. 367882.
Figure 2:
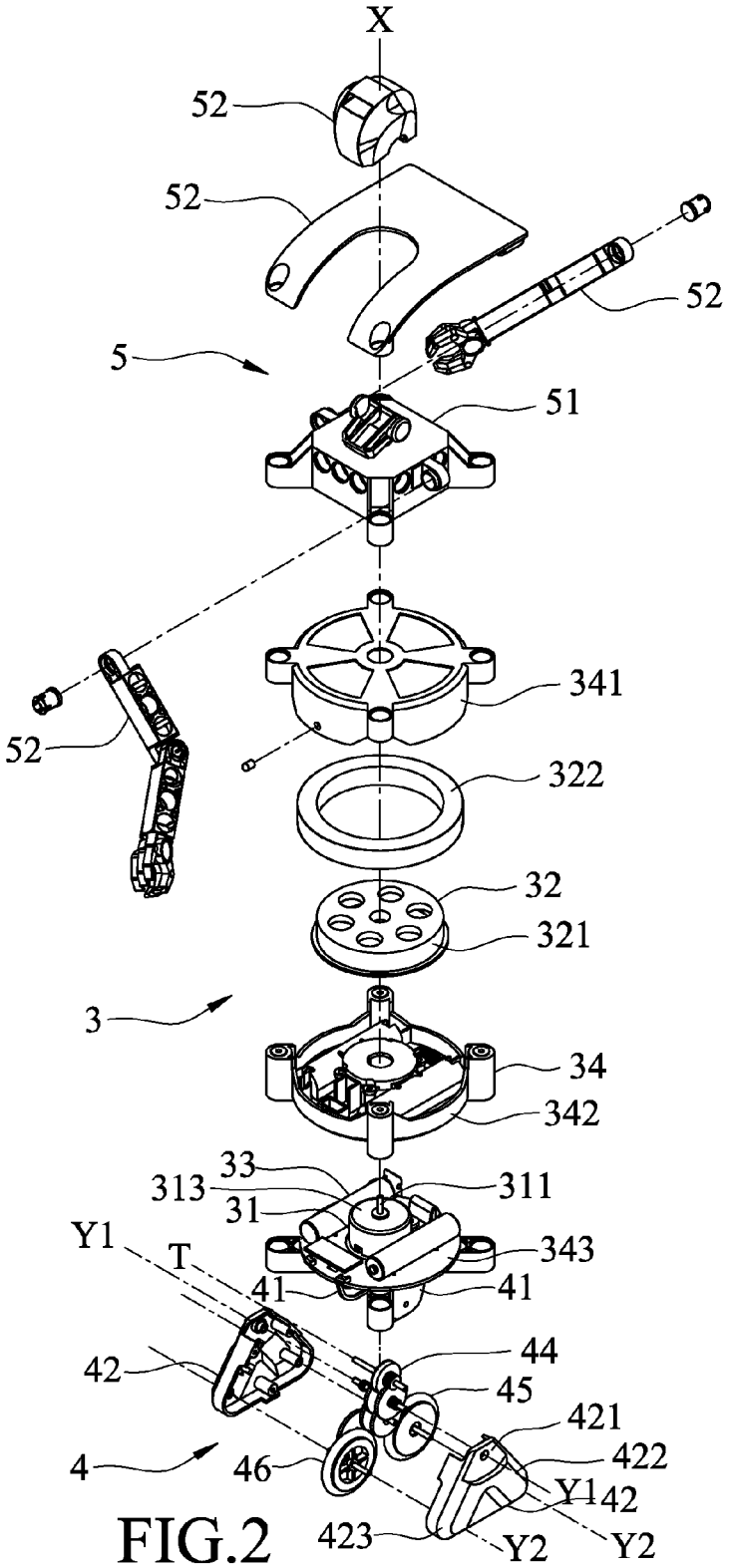
FIG. 2 is a partly exploded perspective view of a preferred embodiment of a traveling toy according to the invention.
Figure 3:
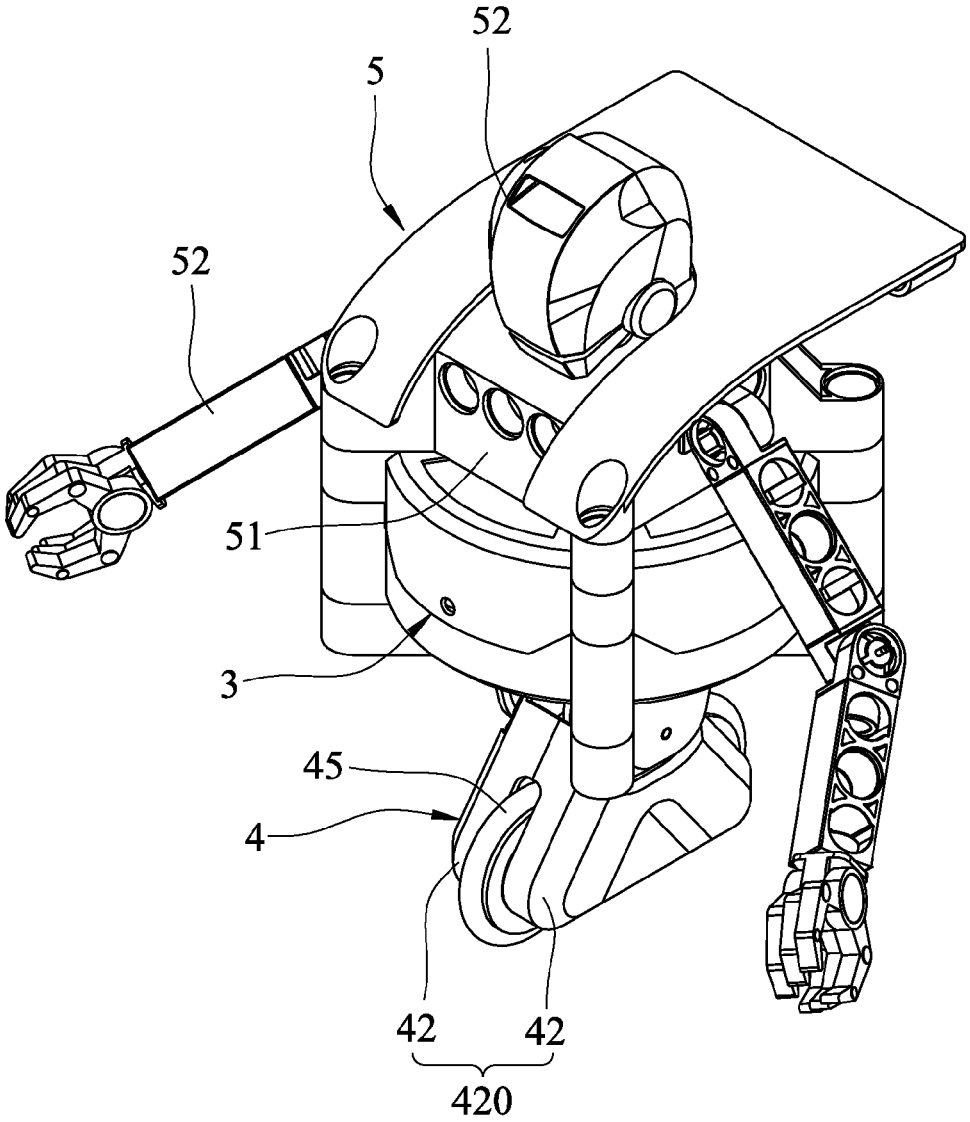
FIG. 3 is an assembled perspective view of the preferred embodiment.
Figure 4:
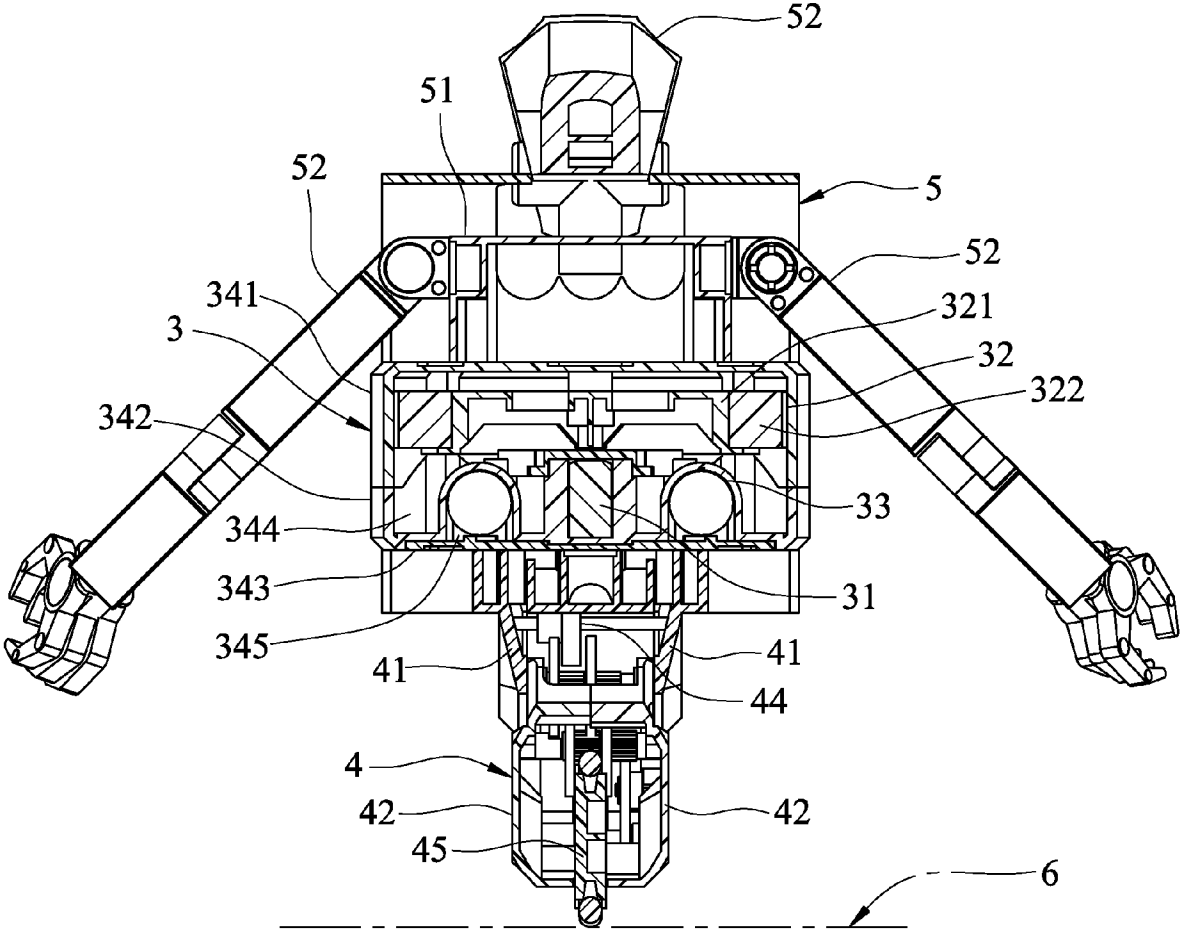
FIG. 4 is a sectional view of the preferred embodiment.
Figure 5:
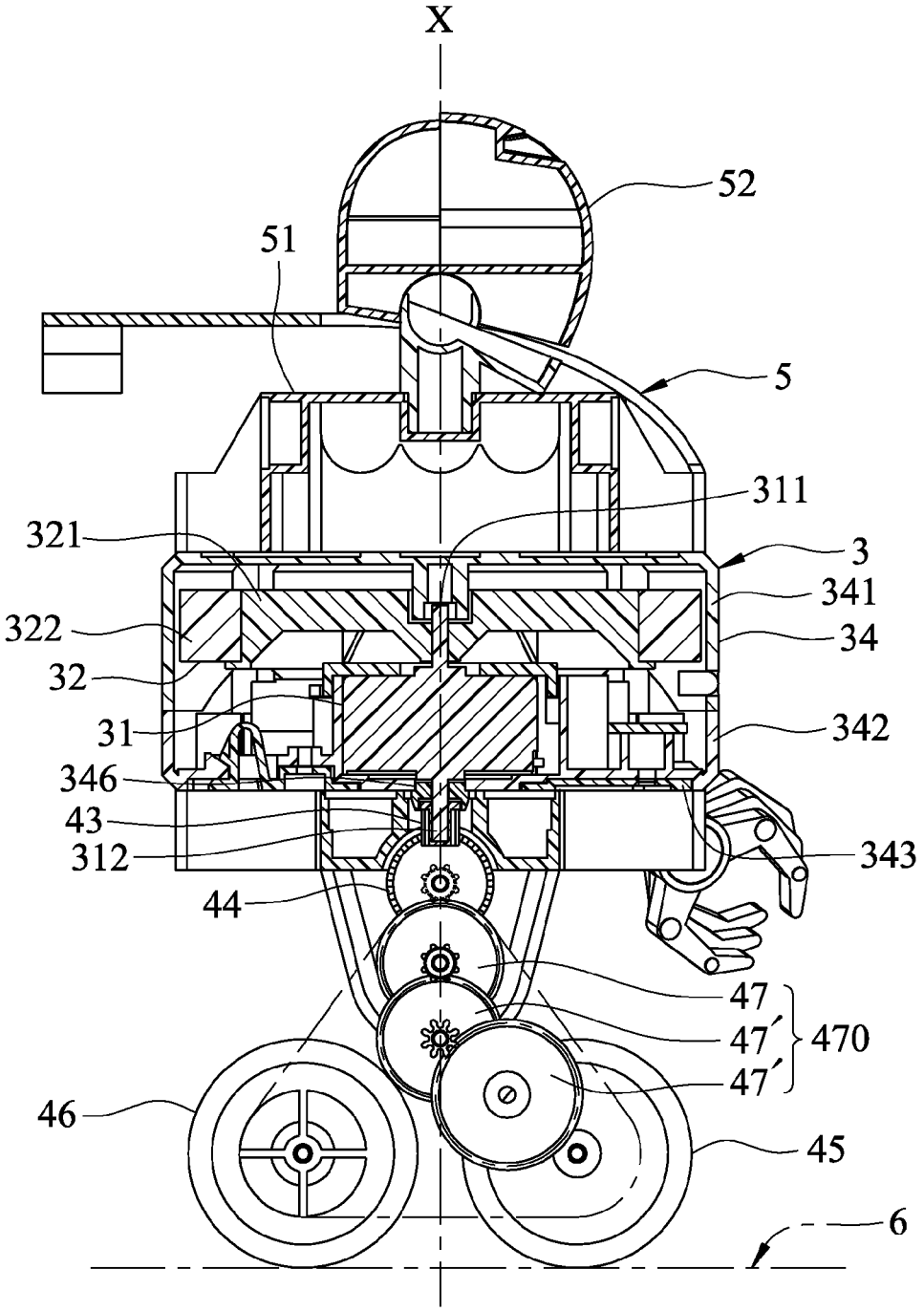
FIG. 5 is a fragmentary sectional view of the preferred embodiment.

As shown in FIGS. 2 to 5, a preferred embodiment of a traveling toy according to the present invention includes a gyroscopic unit 3, a traveling unit 4 and an ornamental toy unit 5.

The gyroscopic unit 3 includes a motor 31, a rigid body 32, a power source 33, a casing 34, a driving gear 43 and a transmission gear 44.

The motor 31 has co-rotatable upper and lower output shafts 311, 312 (see FIG. 5) that extend along a vertical axis (X), and that are disposed respectively at opposite upper and lower sides of a main body 313 of the motor 31. The rigid body 32 has a rotational symmetry, and includes a disc 321 that is mounted co-rotatably on the upper output shaft 311 of the motor 31, and a flywheel 322 that is mounted co-rotatably on the disc 321. In this embodiment, the flywheel 322 is ring-shaped and is sleeved on the disc 321.

The casing 34 includes interconnected first, second and third casing segments 341, 342, 343. The second casing segment 342 is connected below the first casing segment 341, and cooperates with the first casing segment 341 to define a first retaining space 344 therebetween. The third casing segment 343 is connected below the second casing segment 342, cooperates with the second casing segment 342 to define a second retaining space 345 therebetween, and has a lower portion formed with a through hole 346. The main body 313 of the motor 31 is retained in the second retaining space 345. The upper output shaft 311 of the motor 31 extends into the first retaining space 344 through the second casing segment 342. The lower output shaft 312 of the motor 31 extends out of the casing 34 through the through hole 346 of the third casing segment 343. The power source 33 is retained in the second retaining space 345, and provides electric power to the motor 31. The rigid body 32 is retained in the first retaining space 344.

The driving gear 43 is mounted co-rotatably on the lower output shaft 312 of the motor 31.

The casing 34 further includes a pair of brackets 41 that are spaced apart from each other along a horizontal transmission axis (T) perpendicular to the vertical axis (X), and that project downwardly from the lower portion of the third casing segment 343 of the casing 34.

The transmission gear 44 is disposed between the brackets 41, meshes the driving gear 43, and is rotatable about the horizontal transmission axis (T).

The traveling unit 4 is disposed below the gyroscopic unit 3, and includes a foot frame 420 (see FIG. 3), a gear train 470 (see FIG. 5), a first bottom wheel 45 and a second bottom wheel 46.

The foot frame 420 includes a pair of interconnected foot frame components 42 that are connected respectively and pivotally to lower portions of the brackets 41, and that are rotatable relative to the brackets 41 about a first horizontal axis (Y1) perpendicular to the vertical axis (X) and parallel to the transmission axis (T).

The first and second bottom wheels 45, 46 are adapted for traveling on a surface 6, are spaced apart from each other, and are disposed between the foot frame components 42. The first and second bottom wheels 45, 46 are respectively rotatable about two parallel second horizontal axes (Y2) perpendicular to the vertical axis (X) and parallel to and below the first horizontal axis (Y1).

In this embodiment, each of the foot frame components 42 is triangular, and has first, second and third vertex portions 421, 422, 423. The first vertex portions 421 of the foot frame components 42 are connected pivotally and respectively to the lower portions of the brackets 41. The first bottom wheel 45 is disposed between the second vertex portions 422 of the foot frame components 42. The second bottom wheel 46 is disposed between the third vertex portions 423 of the foot frame components 42, and is disposed in line with the first bottom wheel 45.

The gear train 470 is disposed between the foot frame components 42, is disposed between and meshes the transmission gear 44 and the first bottom wheel 45 for providing gear reduction, and includes a first train gear 47 and a plurality of second train gears 47'. The first train gear 47 meshes the transmission gear 44, and is rotatable about the first horizontal axis (Y1). The second train gears 47' are disposed between the first train gear 47 and the first bottom wheel 45 for transmitting mechanical power from the first train gear 47 to the first bottom wheel 45.

The ornamental toy unit 5 includes a plurality of modular toy components 51, 52. In this embodiment, the modular toy components 51, 52 are assembled as an upper body of a human figure.

When the upper and lower output shafts 311, 312 rotate, the first bottom wheel 45 is driven to rotate, such that the traveling toy of this invention is able to travel on the surface 6 by the first and second bottom wheels 45, 46 thereof. Meanwhile, the rigid body 32 is driven to generate gyroscopic effect such that the upper and lower output shafts 311, 312 are maintained upright without additional power. Moreover, since the foot frame 420 is connected pivotally to the casing 34 of the gyroscopic unit 3 about the first horizontal axis (Y1) and the first train gear 47 of the gear train 470 is rotatable about the first horizontal axis (Y1), the traveling unit 4 is able to travel on an uneven surface with the upper and lower output shafts 311, 312 being kept upright.

To sum up, despite having an unstable and relatively simple structure, the traveling toy of this invention is able to travel linearly on a planar or an uneven surface by virtue of the gyroscopic effect of the gyroscopic unit 3 thereof, and has educational and recreational capabilities.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A traveling toy comprising:

a gyroscopic unit including a motor that has co-rotatable upper and lower output shafts extending along a vertical axis, a rigid body that has a rotational symmetry, and that is mounted co-rotatably on said upper output shaft of said motor, a driving gear that is mounted co-rotatably on said lower output shaft, and a transmission gear that meshes said driving gear, and that is rotatable about a horizontal transmission axis perpendicular to the vertical axis;

a traveling unit disposed below said gyroscopic unit, and including a first bottom wheel that is adapted for traveling on a surface, and a gear train that is disposed between and that meshes said transmission gear and said first bottom wheel; and an ornamental toy unit provided on said gyroscopic unit;

wherein said traveling unit further includes a second bottom wheel adapted for traveling on the surface, said first and second bottom wheels being rotatable respectively about two parallel second horizontal axes parallel to and below the horizontal transmission axis and arranged along an axis that is perpendicular to the parallel second horizontal axes, wherein said gyroscopic unit further includes a pair of brackets that are spaced apart from each other along the transmission axis and that project downwardly, said transmission gear being disposed between said brackets;

wherein said traveling unit further includes a pair of interconnected foot frame components that are connected respectively and pivotally to lower portions of said bracket, and that are rotatable relative to said brackets about a first horizontal axis perpendicular to the vertical axis, said first and second bottom wheels being spaced apart from each other and being disposed between said foot frame components, and wherein said gear train of said traveling unit includes a first train gear that meshes said transmission gear and that is rotatable about the first horizontal axis, and a plurality of second train gears that are disposed between said first train gear and said first bottom wheel for transmitting mechanical power from said first train gear to said first bottom wheel.

2. The traveling toy as claimed in claim 1, wherein said rigid body includes a disc mounted co-rotatably on said upper output shaft of said motor, and a flywheel mounted co-rotatably on said disc.

3. The traveling toy as claimed in claim 2, wherein said flywheel is ring-shaped and is sleeved on said disc.

4. The traveling toy as claimed in claim 1, wherein said gyroscopic unit further includes a casing that contains said motor and said rigid body, and that is formed with a through hole through which said lower output shaft extends.

5. The traveling toy as claimed in claim 4, wherein said gyroscopic unit further includes a power source that is retained in said casing and that provides electric power to said motor.

6. The traveling toy as claimed in claim 5, wherein said casing includes interconnected first, second and third casing segments, said second casing segment being connected below said first casing segment, and cooperating with said first casing segment to define a first retaining space for retaining said rigid body, said third casing segment being connected below said second casing segment, and cooperating with said second casing segment to define a second retaining space for retaining a main body of said motor and said power source, said through hole being formed in said third casing segment.

7. The traveling toy as claimed in claim 1, wherein said ornamental toy unit includes a plurality of modular toy components.

* * * * *